US008079738B1

(12) United States Patent
Schlappi et al.

(10) Patent No.: US 8,079,738 B1
(45) Date of Patent: Dec. 20, 2011

(54) HINGEABLE SECURITY LIGHT GLOBE COVER AND METHOD OF USE

(76) Inventors: Charles Andrew Schlappi, Waynesburg, KY (US); Cecil Herman Schlappi, Lindenhurst, IL (US)

( * ) Notice: Subject to any disclaimer, the term of this patent is extended or adjusted under 35 U.S.C. 154(b) by 253 days.

(21) Appl. No.: 12/604,392

(22) Filed: Oct. 23, 2009

Related U.S. Application Data

(60) Provisional application No. 61/107,350, filed on Oct. 22, 2008.

(51) Int. Cl.
*F21V 17/00* (2006.01)

(52) U.S. Cl. ..... 362/375; 362/363; 362/364

(58) Field of Classification Search ..... 362/375, 362/363, 364
See application file for complete search history.

(56) References Cited

U.S. PATENT DOCUMENTS

| | | | | |
|---|---|---|---|---|
| 6,250,776 | B1 * | 6/2001 | Burkitt et al. | 362/267 |
| 2009/0196053 | A1 * | 8/2009 | Ziobro et al. | 362/365 |
| 2010/0085766 | A1 * | 4/2010 | Czech et al. | 362/365 |

* cited by examiner

*Primary Examiner* — Evan Dzierzynski

(74) *Attorney, Agent, or Firm* — Raymond N. Ervin, Ltd.

(57) ABSTRACT

The present invention specifically relates to a HINGEABLE SECURITY LIGHT GLOBE COVER AND METHOD OF USE that is specifically designed to prevent damage to security light fixtures due to both direct and indirect damage from birds and other noxious pest that take residence in the electrical fixture causing damage by overheating of ballasts or destruction of electrical components. The invention provides a means of securing the fixture from pests while simultaneously providing additional protection from ultraviolet (UV) radiation from damaged bulbs. The hingeable security light globe cover may be secured to the globe of a security light by at least one hingeable mechanism, which may further comprise an internal mounting flange, a handle assembly, an alignment guide and a latch assembly. The security light globe cover may comprise any translucent material of construction known in the Optical Arts capable of enduring the environmental rigors imposed upon a security light and possessing ultraviolet and impact resistance. An embodiment of internal mounting flange having an adjustable clamping arrangement is also disclosed. Another embodiment of the HINGEABLE SECURITY LIGHT GLOBE COVER that foregoes the use of an internal mounting flange is also disclosed. The unique arrangement of the HINGEABLE SECURITY LIGHT GLOBE COVER affords the user reduced maintenance due to pest related problems and only a negligible expenditure of additional effort in replacing spent bulbs, as all maintenance is anticipated without use of ladders or elevated work platforms.
Additional embodiments providing differing arrangements of the primary elements a method of use are also disclosed.

6 Claims, 4 Drawing Sheets

HINGEABLE SECURITY LIGHT GLOBE COVER AND METHOD OF USE

CLAIM FOR PRIORITY OF INVENTION

This application claims the benefit of U.S. Provisional Application Ser. No. 61/107,350, Hingeable Security Light Globe Cover and Method of Use, filed 22 Oct. 2008, presently pending, in accordance with 35 USC §119 (e).

CROSS-REFERENCE TO RELATED APPLICATIONS

This application claims the benefit of U.S. Provisional Application Ser. No. 61/107,350, Hingeable Security Light Globe Cover and Method of Use, filed 22 Oct. 2008, presently pending, in accordance with 35 USC §§119 (e), 120 wherein the respective disclosures of which are hereby incorporated by reference herein.

FEDERALLY SPONSORED RESEARCH OR DEVELOPMENT

There has been no research or development sponsored in whole or part by the Federal government or any agency thereof in respect to the instant invention.

BACKGROUND OF THE INVENTION

1. Field of the Invention

The present invention specifically relates to a HINGEABLE SECURITY LIGHT GLOBE COVER AND METHOD OF USE capable of preventing birds, bats and rodents from seeking refuge in the internal electrical housing of a security light, wherein the electrical circuitry and components may be damaged directly or indirectly from the actions of these offending pests. The invention further provides additional protection from ultraviolet (UV) light from high pressure and low pressure discharge lights due to cracks in their bulbs that may occur as a function of impact from animals or deliberate acts of vandalism, through the incorporation of an ultraviolet resistant diffuser grating in the security light globe cover. A method whereby an individual user may facilitate the routine service of replacement of the lamp bulb from the ground wherein the security light is within a predetermined height from the ground is also disclosed.

2. Description of the Related Art

An effective means for preventing offending pests such as birds, bats and rodents from taking up residence within the electrical housing of security light, especially in rural areas has long been sought. The security lights are often damaged from these pests either indirectly, as in the case where the nests and droppings of the animal may cause the ballast to overheat and fail, or directly as in the case of bats and rodents that may chew through wires, causing shorts, damaging circuits and interrupting power to the light. Due to the labor costs involved in facilitating the repair of these units, it is most often a more cost effective option to replace the entire light assembly rather than to clean, diagnose and repair the unit. This often requires that an individual repairman must climb the pole or use a lift to gain access to the damaged security light. Thereafter, he must determinate the line power, physically remove the damaged light, reinstall the new unit and re-terminate the line power. This process poses the potential risk of the individual repairman falling from the lift device or from the pole or electrocution by inadvertently contacting a power line in the course of the replacement of the security light fixture. This situation is greatly amplified in rural areas wherein a more significant population of birds and bats are disproportionately higher in comparison to the manpower constraints allocated to the expansive territorial demands. This most often results in overburdened personnel having to endure working long hours without assistance, which presents a significant safety risk, and the utility suffering a significant labor and capital expense to replace damaged security fixtures.

Given the multitude of shortcomings and disadvantages regarding the existing approaches to maintain security lighting systems it would be desirable to have an affordable and convenient solution within the grasp of the average consumer of this commodity that could allow the security fixture to enjoy an operational period that more closely approximated the engineered life span by the elimination of damage to the internal electrical components, while simultaneously providing a convenient means for replacing bulbs without the need to either climb or use a lift. The present invention satisfies such a need.

SUMMARY OF THE INVENTION

The present invention specifically relates to a HINGEABLE SECURITY LIGHT GLOBE COVER AND METHOD OF USE wherein a security light globe cover may be secured to the globe of a security light by at least one hingeable mechanism, which may further comprise an alignment guide and a latch assembly. The security light globe cover may comprise any translucent material of construction known in the Optical Arts capable of enduring the environmental rigors imposed upon a security light and possessing ultraviolet and impact resistance, while simultaneously affording the transmission of not less than 90% of the light generated from the security light. The security light globe cover may have a predetermined shape that corresponds with the globe such that it affords the cover to be received in the opening of the globe and articulated based upon the orientation of the hingeable elements. The security light globe cover may also have at least one flange of a hingeable mechanism affixed to the security light globe cover and the other flange attached to the globe of the security light by any means known in the Mechanical Arts such as gluing, riveting, bolting, and screwing. The security light globe cover may also have at least one cover alignment guide, which is received in a corresponding globe alignment guide; wherein the cover alignment guide may be affixed to security light globe cover by any means known in the Mechanical Arts such as gluing, riveting, bolting, screwing or formed as an integral element of the security light globe cover; and the respective globe alignment guide may be affixed by any means known in the Mechanical Arts such as gluing, riveting, bolting and screwing to the globe. The security light globe cover may comprise a solid surface or may comprise a grating of a series of openings of a predetermined size and shape to optimize the diffraction of the light while preventing birds and bats from accessing the security light electrical components. The security light globe cover may also comprise a latch assembly that may be mechanical or magnetic, wherein one element of the latch may be attached to the security light globe cover and the corresponding element attached to the globe by any means known in the Mechanical Arts such as gluing, riveting, bolting and screwing. The portion of the latch assembly attached to the cover may further possess a hook, ring or handle element that would facilitate the opening and closing of the cover by use of a lineman's extension pole.

The proposed method of use of the hingeable security light globe cover may consist of the following sequence wherein an individual user or lineman (typ.) is required to replace the bulb in a security lamp:

1. The lineman extends a lineman's extension pole to reach the handle of the hingeable security light security light globe cover.
2. Engaging the handle element the lineman pulls downward to open the hingeable security light globe cover and gain access to the bulb.
3. The lineman then utilizes an extendable bulb changer and removes the defective bulb and installs a new bulb.
4. After confirming the operation of the security lamp with the new bulb, the lineman utilizes the lineman's extension pole to close and latch the hingeable security light globe cover.

The preferred methodology for the proper installation and utilization of the Hingeable Security Light Globe Cover is also provided herein. Various aspects of the invention are novel, non-obvious, and provide various advantages. While the actual nature of the present invention covered herein can only be determined with reference to the claims appended hereto, certain features, which are characteristic of the embodiments disclosed herein, are described briefly as follows:

A first aspect of the invention provides for a Hingeable Security Light Glove Cover wherein:

A Hingeable Security Light Globe Cover, comprising a security light globe cover of a predetermined shape that corresponds with a security light globe such that it affords the security light globe cover to be received in the opening of the globe and articulated based upon the orientation of the hingeable elements; at least one hingeable mechanism, which may have flanges that permit the cover to pivot a minimum of 90°, at least one alignment guide, which comprises a cover alignment element affixed to the security light globe cover that is received in a corresponding globe alignment element affixed to the security light globe and at least one latch assembly, which comprises a latch and a corresponding strike attached to one of either the security light globe and security light globe cover; wherein the hingeable mechanism, alignment guide and latch assembly are operably connected to the security light globe cover and security light globe such that the hingeable security light globe cover may be accessed and secured by an individual using an extension pole engaging a handle element, which may comprise a handle of a predetermined shape or size suitable to accommodate the end of a lineman's extension pole, that is attached to the security light globe cover.

The advantages to the Hingeable Security Light Globe Cover are immediately realized as both a capital savings when the user is no longer faced with the task of replacing security lights damaged by the actions of birds or bats roosting in the proximity of the ballasts causing overheating or damaging the wiring and electrical components, and as a labor savings as the lineman can now conveniently open the security light globe cover and replace defective bulbs without the need to climb the utility pole. Additional advantages may be gleaned from the use of UV resistant construction in reducing public exposure to harmful UV radiation from defective or damaged high pressure vapor bulbs.

DETAILED DESCRIPTION OF THE PRESENTLY PREFERRED EMBODIMENTS

Referring to FIGS. 1-11 illustrate the preferred embodiments of a HINGEABLE SECURITY LIGHT GLOBE COVER AND METHOD OF USE in accordance with the present invention.

Figure 1:
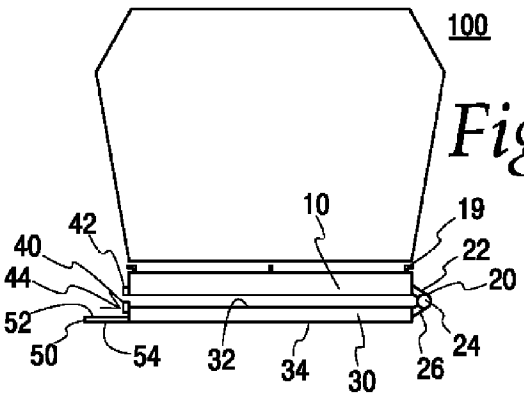
FIG. 1 is a drawing of the Hingeable Security Light Globe Cover, showing a side view of the security light with a hingeable security light globe cover attached to the security light globe base wherein, the arrangement of the various elements of the Hingeable Security Light Globe Cover are demonstrated.

Referring to FIG. 1 the present embodiment of the Hingeable Security Light Globe Cover System is generally shown at 100. The Hingeable Security Light Globe Cover 100 may comprise an internal mounting flange 10 that may be mounted in the aperture of a security light globe that is pivotally connected by a hinge assembly 20 to a security light globe cover 30, which may be maintained in the closed position by an integral latch assembly 40, which may have elements incorporated in the internal mounting flange 10 and the security light globe cover 30; and having a handle assembly 50 that may be secured to the security light globe cover 30 to facilitate access to the security lighting elements and electrical components. The internal mounting flange may have a predetermined shape having a first side 12 (FIG. 9), a second side 14 (FIG. 9), a top side 16 (FIG. 9) and a bottom side 18 (FIG. 9) that demonstrates substantial agreement with the geometry of internal surface of the security light globe aperture, which permits the internal mounting flange 10 to exhibit a friction fit against the internal surface of the security light globe in the immediate proximity of the security light globe aperture. In another embodiment, the internal mounting flange may also comprise any number of internal mounting flange latching fingers 19 (FIG. 1) located about the perimeter that may exert tensional force against the internal surface of the security light globe and the internal mounting flange 10. The internal mounting flange 10 may comprise any material of construction selected from a group consisting of ferrous metals, nonferrous metals, plastics, ceramics and combinations of the aforementioned that are known in the Mechanical Arts for being capable of enduring the rigors of temperature cycling, ultraviolet (UV) exposure, rain, snow, hail and ice without warping or significantly altering the tensile and compressive strength or altering the dimensional aspects of the internal mounting flange 10.

The internal mounting flange 10 may be pivotally connected to the security light globe cover 30 by a hinge assembly 20 having a first hinge flange 22 and a second hinge flange 26 that are pivotally connected at their respective first ends by a hinge pivot 24, wherein the second ends of the first hinge flange 22 and second hinge flange 26 are respectively secured to the internal mounting flange bottom side 18 (FIG. 9) and the security light globe cover top side 32 (FIG. 2) by connectors 60 (FIGS. 6, 7), which may comprise screws, rivets, nuts and bolts, clips and pins. An alternate embodiment provides for the second ends of the first hinge flange 22 and second hinge flange 26 may be respectively integrally formed into the internal mounting flange 10 and security light globe cover 30, which are pivotally connected at their respective first ends by a hinge pivot 24. In another embodiment, alternate joining means known in the Mechanical Arts such as welding, soldering, brazing and gluing may replace the connectors 60 (FIGS. 6, 7).

Figure 2:
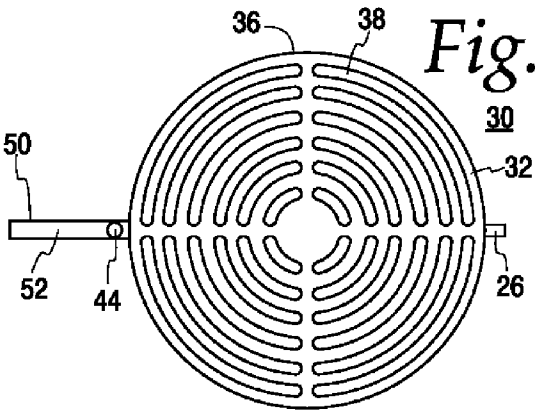
FIG. 2 is a drawing of a top view of the of the hingeable security light globe cover, showing the arrangement of the handle, magnetic latch and the hinge.
Figures 10, 11:
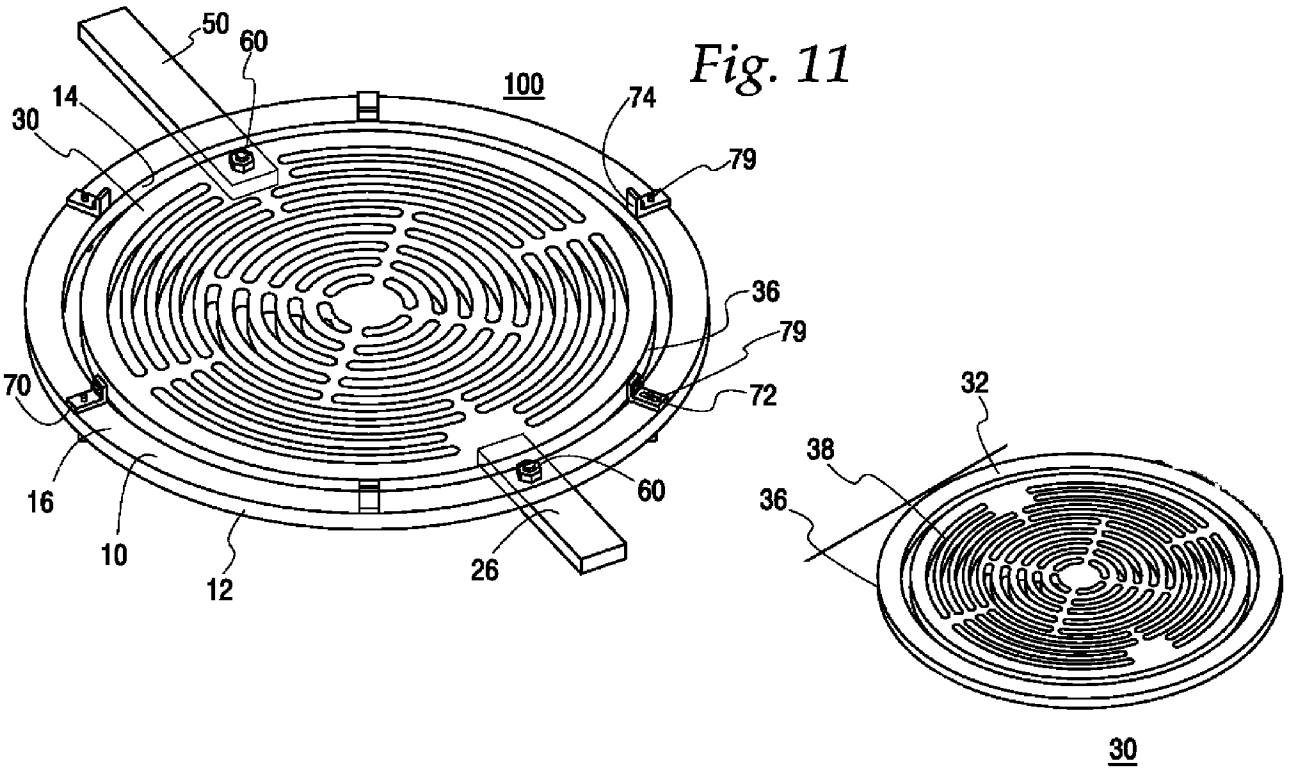
FIG. 10 is a drawing of a top perspective view of the preferred embodiment of the hingeable security light globe cover.
FIG. 11 is a drawing of a top perspective view of the preferred embodiment of the hingeable security light globe cover possessing a handle element and a hinge flange, in corresponding agreement with an alternate embodiment of the hingeable security light globe cover internal mounting flange with a plurality of adjustable clamps positioned about the circumference.

Referring to FIG. 2 the security light globe cover is generally shown at 30. The security light globe cover 30 may comprise a transparent, predetermined geometric shape that demonstrates corresponding agreement with the aperture of the security light globe, which may further comprise fabrication from any material of construction known in the Optical Arts capable of permitting the transmission of not less than 90% of the available light energy from the security light, selected from a group consisting of polymers, ceramics, and reticulated metal gratings. The security light globe cover 30 may have a security light globe cover top side 32 FIGS. 1, 2, 8, 10, 11), a security light globe cover bottom side 34 (FIGS. 1, 8), a security light globe cover peripheral edge 36 and a plurality of security light globe cover apertures 38. Turning to FIG. 10, a drawing of the present embodiment of a circular transparent security light globe cover 30 is generally shown against a contrasting background, wherein the security light globe cover top side 32, the security light globe cover peripheral edge 36 and a plurality of security light globe cover apertures 38 are detailed as to their relative orientation. Returning to FIG. 2, the handle assembly 50 having a handle first side 52 (FIGS. 1, 7, 8), a handle second side 54 (FIGS. 1, 6, 7, 8) and a handle recess 56 (FIGS. 6, 7), is secured to the security light globe cover bottom side 34 (FIGS. 8, 11) by connectors 60 (FIGS. 8, 11), wherein latch magnetic strike 44 (FIG. 1) located on the handle first side 52 (FIG. 1) may comprise any magnet known in the Mechanical Arts to be of sufficient strength as to firmly maintain the security light globe cover 30 in a closed position despite incidences of severe inclement weather or the attempts by birds and offensive pests to open the security light globe cover 30; which is attached to a predetermined location on the security light globe cover 30 (FIG. 1) in confrontational relation to the latch strike plate 42 (FIG. 1) affixed to the internal mounting flange 10 (FIG. 1).

Figure 3:
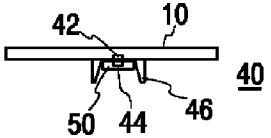
FIG. 3 is a drawing of a side view of the mounting flange of the hingeable security light globe cover with fingers used to guide the hingeable security light globe cover into proper position, upon assembly and disassembly.

Referring to FIG. 3 another embodiment of the latch assembly is generally shown at 40. The latch assembly 40 as shown in this embodiment may also comprise a latch alignment guide 46 that may be secured to the internal mounting flange 10 by connectors 60 (FIG. 7) or by any means known in the Mechanical Arts such as welding, soldering, brazing, riveting or gluing. In another embodiment, the latch alignment guide 46 may be formed as an integral component of the internal mounting flange 10. The latch alignment guide 46 may be constructed of materials of construction similar to and compatible with the material of construction of the internal mounting flange 10. The latch alignment guide 46 may further comprise at least one guide of a predetermined geometry, that directs the handle assembly 50, which may have the latch magnetic strike 44 attached to the handle first side 52, whereby the latch magnetic strike 44 is centered and directed to the latch strike plate 42, thus ensuring that these meet in centered confrontational agreement, whereby a positive closure of the hingeable security light globe cover 100 (FIG. 1) is established.

Figure 7:
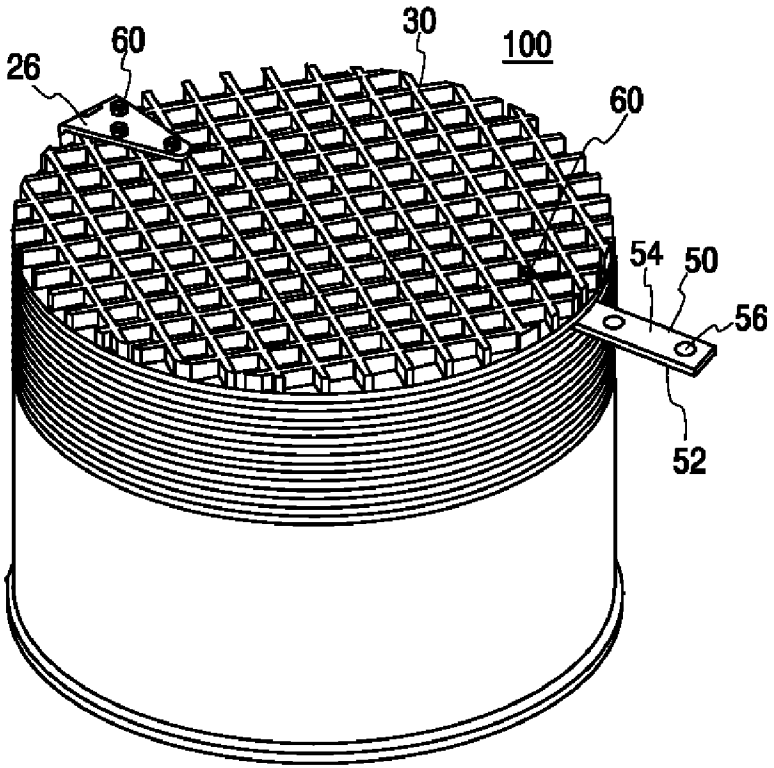
FIG. 7 is a drawing of an inverted perspective bottom front view of a security light globe showing the handle and magnetic latch mechanism engaged and fitted with an alternate embodiment of the Hingeable Security Light Globe Cover, wherein the hingeable security light globe cover incorporates an egg-crate style diffraction grating.
Figure 6:
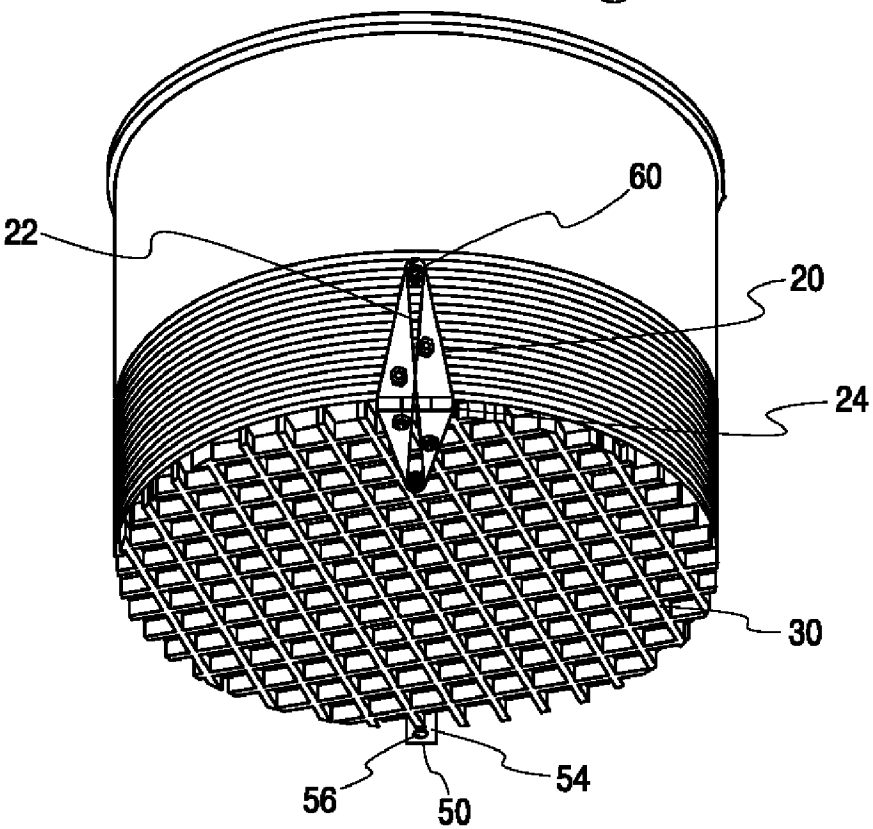
FIG. 6 is a drawing of an inverted perspective bottom rear view of a security light globe showing the hinge arrangement and fitted with an alternate embodiment of the Hingeable Security Light Globe Cover, wherein the hingeable security light globe cover incorporates an egg-crate style diffraction grating, is in the closed position.
Figure 8:
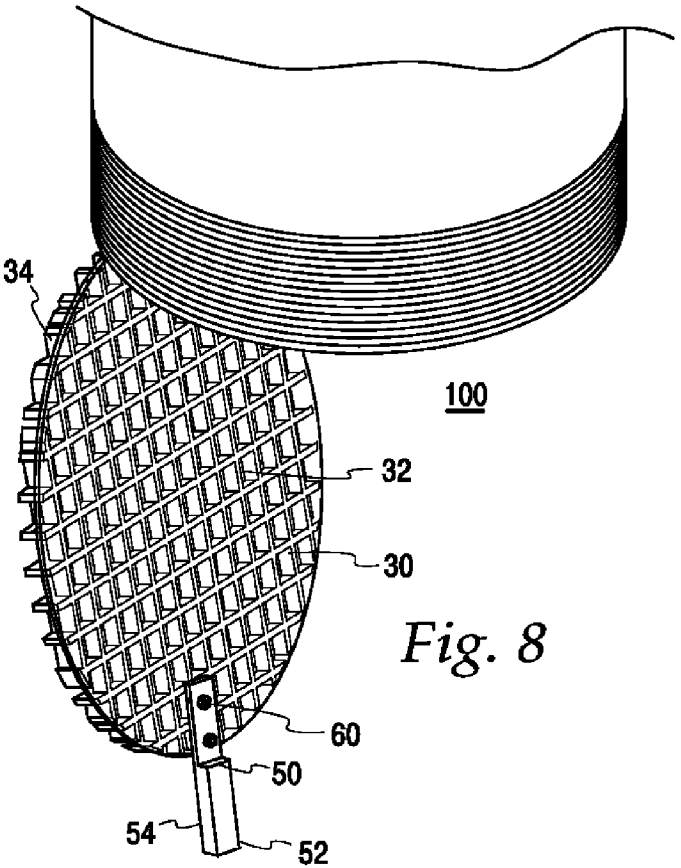
FIG. 8 is a drawing of a perspective bottom side view of a security light globe showing the hingeable security light globe cover in the open position.

Referring to FIGS. 6, 7 and 8 another embodiment of the Hingeable Security Light Globe Cover 100 is demonstrated, wherein the security light globe cover 30 (FIGS. 6, 7, 8) is directly pivotally secured to the security light globe by the hinge assembly 20 (FIG. 6), wherein a first hinge flange 22 (FIG. 6) and a second hinge flange 26 (FIG. 6) that are pivotally connected at their respective first ends by a hinge pivot 24 (FIG. 6), wherein the second ends of the first hinge flange 22 (FIG. 6) and second hinge flange 26 (FIG. 6) are respectively secured to the security light globe and the security light globe cover top side 32 (FIG. 8). This embodiment may only be practiced where the material of construction of the security light globe permit the use of connectors 60 (FIGS. 6, 7) or may be safely modified to receive the hinge assembly 20 (FIGS. 6, 7) without the possibility of causing damage to the security light globe.

Figure 4:
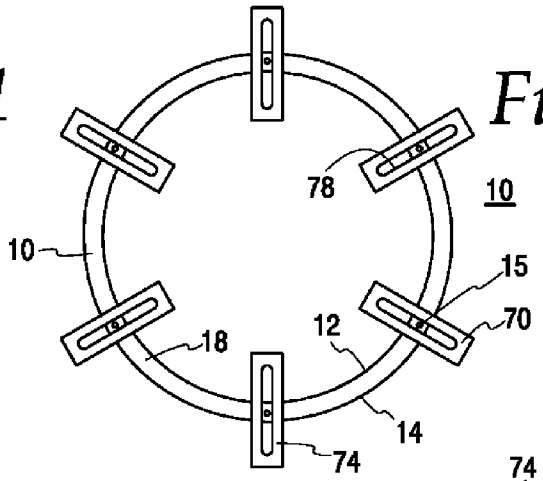
FIG. 4 is a drawing of a top view of an alternate mounting flange utilizing a plurality of adjustable clamps, which provide a means to secure the mounting flange into the bottom of disparate security light globes.
Figure 4B:
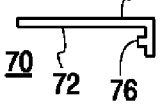
FIG. 4B is a drawing of the top view of the adjustable mounting clamp.
Figure 4A:
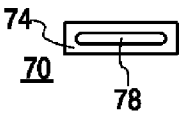
FIG. 4A is a drawing of the side view of the adjustable mounting clamp.
Figure 9:
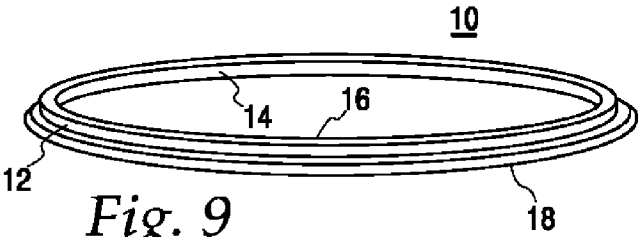
FIG. 9 is a drawing of a perspective side view of the hingeable security light globe cover internal mounting flange.
Figure 9A:
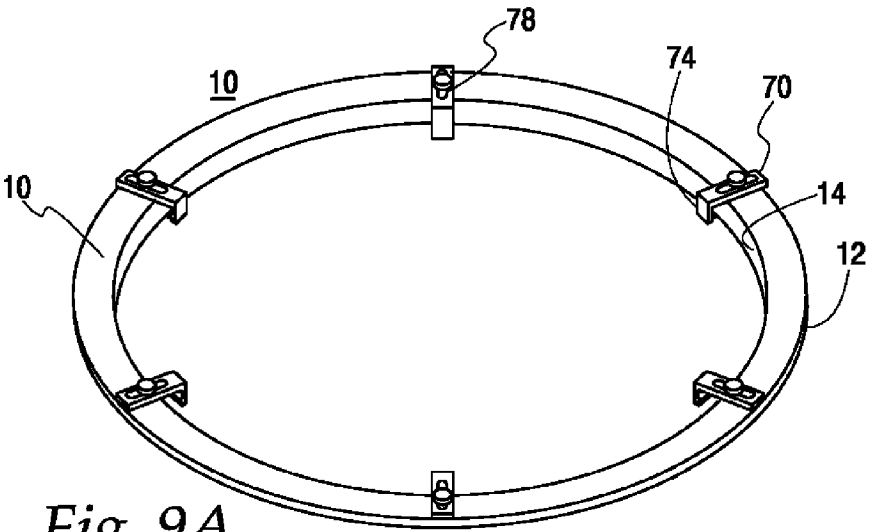
FIG. 9A is a drawing of a perspective bottom view of an alternate embodiment of the hingeable security light globe cover internal mounting flange demonstrating the use of adjustable clamps to secure the mounting flange to the security light globe positioned about the circumference of the mounting flange.

Referring to FIGS. 4, 9A and 11 another embodiment of the Hingeable Security Light Globe Cover 100 is presented, wherein the internal mounting flange 10 has been modified to adjustably accommodate a range of interior dimensions of a predetermined geometry of a security light globe. Turning to FIG. 11, the Hingeable Security Light Globe Cover is generally shown at 100. The security light cover 30 which is affixed to a handle assembly 50 and a second hinge flange 26 by connectors 60. The security light cover top side 32 may be in substantial alignment with the internal mounting flange top side 16 and the security light globe cover peripheral edge 36 may maintain a substantially parallel spacing from the internal mounting flange second side 14 such that a relatively small uniform space is maintained between the security light globe cover 30 and the internal mounting flange 10 that provides for the hingeable movement of the security light globe cover 30 while denying access to birds and other pests. The internal mounting flange 10 may be fitted with a plurality of adjustable mounting flange clamps 70 located at predetermined locations about the perimeter surface, where a threaded recess 15 (FIG. 4) is similarly located. Turning to FIG. 4, the adjustable mounting clamp 70 may possess a predetermined rectangular shape of a predetermined length, width and gauge having a bent angulation ranging from 90° to 135° inclusive at a predetermined location about its length, having a first side 72, a second side 74, a slot 78 of predetermined length and width about the midline major length and a projection 76 (FIG. 4A) on the first side 72 (FIG. 4B) minor length. The adjustable mounting clamp first side 72 is designed to rest on the internal mounting flange bottom side 18 in a predetermined location where the slot 78 is centered above the threaded recess 15 in the internal mounting flange 10 where a thumbscrew 79 (FIGS. 5, 9A) is inserted and tensioned to secure the adjustable mounting flange clamp 70 to the internal mounting flange 10. Referring to FIG. 9A an assembled internal mounting flange 10 incorporating a plurality of adjustable mounting clamps 70 is shown slightly ajar of the aperture of the security light globe.

Figure 5:
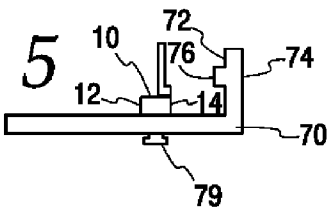
FIG. 5 is a drawing of a sectional side view of the arrangement of the adjustable mounting flange, adjustable mounting clamp and the security light globe, wherein the adjustable mounting clamp is positioned to accommodate a tensional fit against the internal surface of the security light globe as a means of securing the adjustable mounting flange.

Referring to FIG. 5 a side view of the adjustable mounting clamp is generally shown at 70 wherein the operational configuration is displayed. The adjustable mounting clamp 70 is mounted on the internal mounting ring 10, wherein it rests on the internal mounting flange bottom side 18 in a predetermined location immediately adjacent to a threaded recess 15 that upon the alignment of the slot 78 (FIG. 4) may receive a thumbscrew 79. The thumbscrew 79 may be tightened to secure the adjustable mounting clamp 70 in a given position subsequent to sliding the adjustable mounting clamp 70 along the axis of the slot 78 to contact the outer surface of the security light globe above its outwardly flaring lip with the land of the projection 76. The projection 76 serves not only to provide a tensionable grip, based upon the flare of the security light globe provides an inherent secondary retention means as a function of the stepped configuration of the projection 76 restricts the attached internal mounting flange 10 from being dislodged from the security light globe as a function of the reduced perimeter geometry, which allow the adjustable mounting clamp 70 to rest upon the external perimeter flare of the lip of the security light globe. This aspect of the adjustable mounting clamp 70 adds an extra dimension of safety to the Hingeable Security Light Globe Cover 100. In another embodiment, the adjustable mounting clamp 70 may incorporate a rubber or polymer based spacer that may be attached by gluing or other accepted means such as screws, rivets, or through a compressive fit as a boot that installs over the projection 76 to further enhance the grip while simultaneously protecting the security light globe from damage from the adjustable mounting clamp 70. In another embodiment, the adjustable mounting clamp 70 may be color coded to assist maintenance personnel in identifying and tracking both routine and abnormal maintenance to security lights, where the color code identifies the year of installation and based upon anomalies a variation of thumbscrews of a different color may identify the maintenance issue the replacement bulb of bulbs, ballast issues, etc.

A method of use of the Hingeable Security Light Globe Cover 100 is also proposed that may consist of the following steps:

1. The lineman identifies a defective security light having the Hingeable Security Light Globe Cover 100 (FIG. 1) affixed over the aperture of the security light globe.
2. The lineman extends a lineman's extension pole to reach the handle assembly 50 (FIG. 1) of the Hingeable Security Light Globe Cover 100 (FIG. 1).
3. Engaging the handle assembly 50 (FIG. 1) the lineman pulls downward to open the hingeable security light globe cover 30 (FIG. 1) and gain access to the bulb.
4. The lineman then utilizes an extendable bulb changer and removes the defective bulb and installs a new bulb.
5. After confirming the operation of the security lamp with the new bulb, the lineman utilizes the lineman's extension pole to engage the handle assembly 50 (FIG. 1) and close and latch the hingeable security light globe cover 30 (FIG. 1).

While the embodiments of the present invention disclosed herein are presently considered to be preferred, various changes and modifications can be made without departing from the spirit and scope of the present invention. The scope of the present invention is indicated in the appended claims, and all changes that come within the meaning and range of equivalents are intended to be embraced therein.

APPENDIX

| LIST OF NUMERALS | |
|---|---|
| 100 | HINGEABLE SECURITY LIGHT GLOBE COVER |
| 10 | INTERNAL MOUNTING FLANGE |
| 12 | INTERNAL MOUNTING FLANGE FIRST SIDE |
| 14 | INTERNAL MOUNTING FLANGE SECOND SIDE |
| 15 | THREADED RECESS |
| 16 | INTERNAL MOUNTING FLANGE TOP SIDE |
| 17 | INTERNAL MOUNTING FLANGE TENSION ELEMENT |
| 18 | INTERNAL MOUNTING FLANGE BOTTOM SIDE |
| 19 | INTERNAL MOUNTING FLANGE LATCHING FINGERS |
| 20 | HINGE ASSEMBLY |
| 22 | FIRST HINGE FLANGE |
| 24 | HINGE PIVOT |
| 26 | SECOND HINGE FLANGE |
| 30 | SECURITY GLOBE COVER |
| 32 | SECURITY GLOBE COVER TOP SIDE |
| 34 | SECURITY GLOBE COVER BOTTOM SIDE |
| 36 | SECURITY GLOBE COVER PERIPHERAL EDGE |
| 38 | SECURITY GLOBE COVER APERTURES |
| 40 | LATCH ASSEMBLY |
| 42 | LATCH STRIKE PLATE |
| 44 | LATCH MAGNETIC STRIKE |
| 46 | LATCH ALIGNMENT GUIDE |
| 50 | HANDLE ASSEMBLY |
| 52 | HANDLE FIRST SIDE |
| 54 | HANDLE SECOND SIDE |
| 66 | HANDLE RECESS |
| 60 | CONNECTORS |
| 70 | ADJUSTABLE MOUNTING FLANGE CLAMPS |
| 72 | ADJUSTABLE MOUNTING FLANGE CLAMP FIRST SIDE |
| 74 | ADJUSTABLE MOUNTING FLANGE CLAMP SECOND SIDE |
| 76 | PROJECTION |
| 78 | SLOT |
| 79 | THUMBSCREW |

What is claimed is:

1. A Hingeable Security Light Globe Cover, comprising an internal mounting flange that is mounted in an aperture of a security light globe that is pivotally connected by a hinge assembly to a security light globe cover, which is maintained in the closed position by an integral latch assembly having elements incorporated in the internal mounting flange and the security light globe cover; and having a handle assembly secured to the security light globe cover to facilitate access to the security lighting elements and electrical components;

an internal mounting flange having a predetermined shape, having a first side, a second side, a top side and a bottom side that demonstrates substantial agreement with the geometry of internal surface of the security light globe aperture, which permits the internal mounting flange to exhibit a friction fit against the internal surface of the security light globe in the immediate proximity of the security light globe aperture, wherein the internal mounting flange comprises a material of construction selected from a group consisting of ferrous metals, non-ferrous metals, plastics, ceramics and combinations of thereof that have established capabilities for enduring the rigors of temperature cycling, ultraviolet (UV) exposure, rain, snow, hail and ice without warping, significantly altering the tensile and compressive strength and altering the dimensional aspects of the internal mounting flange, a security light globe cover of a predetermined shape that substantially corresponds with a security light globe such that it affords the security light globe cover to be received in the opening of the globe and articulated based upon the desired orientation of the hingeable elements;

at least one hingeable mechanism, having flanges that permit the security light globe cover to have a pivotable range comprising a minimum of 90° to 180° inclusive, at least one alignment guide, which comprises a cover alignment element affixed to the security light globe cover that is received in a corresponding globe alignment element affixed to the security light globe and at least one latch assembly, which comprises a latch and a corresponding strike attached to one of either the security light globe and security light globe cover; wherein the hingeable mechanism, alignment guide and latch assembly are operably connected to the security light globe cover and security light globe such that the hingeable security light globe cover is accessed and secured by an individual using an extension pole engaging a handle element, which comprises a handle of a predetermined shape or size suitable to accommodate the end of a lineman's extension pole, that is attached to said security light globe cover.

2. The Hingeable Security Light Globe Cover of claim 1 further comprising translucent construction wherein not less than 90% of the available light energy (in the visible spectrum) is transmitted, constructed of materials selected from a group consisting of polymers, ceramics and reticulated metal gratings.

3. The Hingeable Security Light Globe Cover of claim 2 further comprising a predetermined geometric arrangement of the grating to maximize ventilation, while simultaneously discouraging the ingress of pests and vermin, selected from a group consisting of concentric parabolic elliptical shapes, triangular shapes, circles and rectangular shapes, which are arranged in ranked progression.

4. The internal flange of claim 1 wherein the internal mounting flange is pivotally connected to the security light globe cover by a hinge assembly having a first hinge flange and a second hinge flange that are pivotally connected at their respective first ends by a hinge pivot, wherein the second ends of the first hinge flange and second hinge flange are respectively secured to the internal mounting flange bottom side and the security light globe cover top side by connectors, which comprises screws, rivets, nuts and bolts, clips and pins.

5. The internal mounting flange of claim 1 further comprising a plurality of internal mounting flange latching fingers located about the perimeter that exert tensional force against the internal surface of the security light globe and the internal mounting flange.

6. The Hingeable Security Light Globe Cover of claim 1 wherein, the security light globe cover is directly pivotally secured to the security light globe by the hinge assembly, wherein a first hinge flange and a second hinge flange that are pivotally connected at their respective first ends by a hinge pivot wherein the second ends of the first hinge flange and second hinge flange are respectively secured to the security light globe and the security light globe cover top side.

* * * * *